US005697493A

United States Patent [19]

Sach et al.

[11] Patent Number: 5,697,493

[45] Date of Patent: Dec. 16, 1997

[54] TACTILE FEEDBACK SWITCH ACTUATOR

[75] Inventors: Gary M. Sach, Villa Park; Francisco Palop, Fullerton; William A. Smith, Laguna Hills, all of Calif.

[73] Assignee: Hughes Aircraft, Los Angeles, Calif.

[21] Appl. No.: 491,054

[22] Filed: Jun. 16, 1995

Related U.S. Application Data

[63] Continuation of Ser. No. 710,265, Jun. 4, 1991, abandoned.

[51] Int. Cl.[6] ..... H01H 9/00

[52] U.S. Cl. ..... 200/314; 200/512; 200/313

[58] Field of Search ..... 200/512, 513, 200/516, 517, 521, 314, 313, 341, 342, 345

[56] References Cited

U.S. PATENT DOCUMENTS

| | | | |
|---|---|---|---|
| 4,288,672 | 9/1981 | Puccino | 200/517 X |
| 4,598,181 | 7/1986 | Selby | 200/512 X |
| 4,771,139 | 9/1988 | DeSmet | 200/512 X |
| 4,937,408 | 6/1990 | Hattori et al. | 200/314 |
| 4,954,668 | 9/1990 | Sako | 200/DIG. 47 X |
| 5,280,145 | 1/1994 | Mosier et al. | 200/314 |
| 5,403,984 | 4/1995 | Ogawa | 200/314 |

FOREIGN PATENT DOCUMENTS

| | | | |
|---|---|---|---|
| 2512228 | 10/1975 | Germany | 200/314 |
| 3511496 | 10/1986 | Germany | 200/314 |
| 106827 | 4/1990 | Japan | 200/313 |
| 2164496 | 3/1986 | United Kingdom | 200/314 |

*Primary Examiner*—David J. Walczak

*Attorney, Agent, or Firm*—G. S. Grunebach; M. W. Sales; W. K. Denson-Low

[57] ABSTRACT

A tactile feedback switch actuator for an associated force-actuated switch has a key cap linked to a collapsible dome by an optical fiber, all of which are light-transmittable. The actuator is operated by manually applying an actuating force to the key cap which exceeds the modulus of collapse of the dome. In response, the dome reversibly collapses in a tactile snapping action against the underlying light-transmittable switch panel having pressure-sensitive contacts embedded therein to change the operative state of the switch. When the actuating force is withdrawn, the collapsible dome elastically returns to its uncollapsed condition, while the switch remains in its newly-actuated operative state. The actuator and associated switch are structurally integrated and aligned so that light-emitting pixels in an underlying electroluminescent panel provide visual feedback of the operative state of the switch.

13 Claims, 3 Drawing Sheets

TACTILE FEEDBACK SWITCH ACTUATOR

This is a continuation application Ser. No. 07/710,265, filed Jun. 4, 1991, now abandoned.

TECHNICAL FIELD

The present invention relates generally to a switch. More particularly, the present invention relates to a switch actuator. The present invention particularly, though not exclusively, relates to a tactile feedback switch actuator for a force-actuated switch.

BACKGROUND OF THE INVENTION

Switch consoles for operator control of complex systems are well known in the art. Such consoles typically house large switch matrices. Mechanical push button switches having full-travel lighted actuators are commonly used in these matrices because they can provide tactile and visual feedback to the operator of the instantaneous switching state for each switch. Mechanical push button switches are, however, relatively bulky which is a disadvantage when size is a major design constraint, particularly when a large number of control switches are required for a complex system. The capital and operating expense of mechanical push button switches can also be relatively high.

In view of the inherent disadvantages of mechanical push button switches, it is apparent that a need exists for a more compact control switch having utility in large switch matrices of complex systems. Likewise, it is apparent that a need exists for a switch which is relatively inexpensive in comparison to known push button mechanical switches. Further, a switch is needed having these advantages which nevertheless retains the advantageous characteristics of tactile and visual feedback provided by known lighted full-travel switch actuators.

SUMMARY OF THE INVENTION

The present invention in its first embodiment is a tactile feedback switch actuator. In its second embodiment, the present invention is a force-actuated switch including the tactile feedback switch actuator. In its third embodiment, the present invention is a method of operating the force-actuated switch.

The tactile feedback switch actuator of the present invention comprises a displaceable key cap linked to a reversibly collapsible member by an optical fiber linkage. The collapsible member, optical fiber linkage, and key cap are characterized as light-transmittable, thereby providing a light pathway through the actuator for visual feedback to a switch operator. The actuator is framed by an overlaying bezel on a console which enables the switch operator manual access to the key cap.

In operation, the operator applies a manual actuating force to the key cap which exceeds the modulus of collapse of the collapsible member. This actuating force displaces the key cap and associated optical fiber linkage, thereby transmitting the actuating force to the collapsible member. In response to the actuating force applied thereto, the collapsible member elastically deforms. The member ultimately reaches its modulus of collapse and snaps, thereby collapsing against the underlying switch panel. The actuating force is consequently transmitted across the collapsed member to the switch panel, thereby changing the operative state of the switch to an "on" state or an "off" state.

The collapsible member is reversible in the sense that when the operator withdraws the actuating force from the key cap, the collapsible member elastically returns to its uncollapsed condition, while the switch remains in its newly actuated operative state. If the operator desires to return the switch to its original operative state, the above-recited procedure is simply repeated. The displacement of the key cap and the resultant snap action of the actuator provide tactile feedback to the operator of a change in operative states when actuating a switch in the manner of the present invention.

In the second embodiment of the present invention, the above-described switch actuator is structurally integrated with a force-actuated switch. Accordingly, the collapsible member is disposed upon a switch panel which combines a light-emitting electroluminescent (E/L) panel and a light-transmittable touch panel. The E/L panel has a pixel embedded therein and the touch panel has a pair of pressure-sensitive switch contacts embedded therein. The pixel and contact pair are in direct alignment with the overlying actuator.

The present embodiment is operated by displacing the key cap and linkage to collapse the collapsible member of the actuator in the manner set forth above. The collapsed member displaces the first pressure-sensitive switch contact of the pair in the switch panel against the second pressure-sensitive contact sending a switching signal to remote switch circuitry. Thus the actuating force transmitted to the contacts across the collapsed member causes a change in the operative state of the switch. If the newly-actuated operative state of the switch is "on", the contact also activates the pixel associated with the switch actuator causing it to emit a light beam. The light beam is transmitted to the operator through the touch panel, collapsible member, optical fiber linkage, and key cap, thereby providing the operator with visual feedback that the switch is in its "on" operative state. If the newly-actuated operative state of the switch is "off", the contact deactivates the pixel associated with the switch actuator causing it to terminate emission of the light beam, thereby providing the operator with visual feedback that the switch is in its "off" operative state.

The switch actuator of the present invention advantageously provides the same tactile and visual feedback functions of full-travel lighted actuators for push button switches known in the art. Force-actuated switches employing the switch actuators of the present invention, however, have a considerably lower profile than known push button switches, which enables greater design flexibility in the placement of such switches on a control console. Further, use of the present switch actuator significantly reduces the capital and operating cost of the resulting force-actuated switch in comparison to known push button switches. These advantages render the present force-actuated switch particularly suitable for retrofit onto existing switch consoles, thereby enhancing the console performance at a reduced cost.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
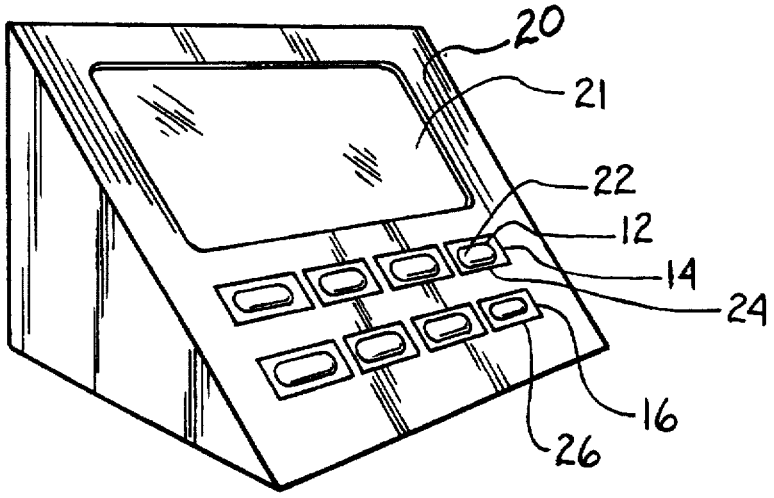
FIG. 1 is a perspective view of a console containing the switch actuators of the present invention.

FIG. 1 shows a console 10 having a plurality of force-actuated switches housed therein. Each switch is externally identifiable by a switch actuator 12. Actuators 12 are disposed in horizontal rows 14, 16, to form a representative 2×4 switch matrix on console face 20. In practice the switch matrix of console 10 may be of any size, such as a 4×6 matrix, or even considerably larger. A display panel 21 associated with the switch matrix is also shown on console face 20.

Each actuator 12 has a key cap 22 which is manually accessible to an operator for fingertip engagement thereof. Key cap 22 is linearly displaceable according to an "in-out" action when the operator applies an actuating force to key cap 22.

Figure 2A:
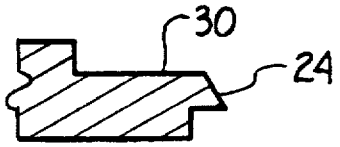
FIG. 2*a* is a cross-sectional side view of a bezel configuration.
Figure 2B:
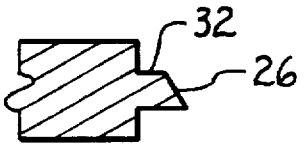
FIG. 2*b* is a cross-sectional side view of a second bezel configuration.

Each key cap 22 is framed by a bezel overlaying switch actuator 12. As shown, key caps 22 of row 14 are framed by bezels 24 and key caps 22 of row 16 are framed by bezels 26. Bezels 24, 26 can be uniquely configured, if desired, to render them tactually distinguishable. For example, FIG. 2*a* shows a cross-section of bezel 24 which has a surface 30 tactually distinguishable by fingertip from surface 32 of bezel 26 which is shown cross-sectionally in FIG. 2*b*. A particular bezel surface configuration, such as surface 30 of bezel 24, can be associated with a given type of switch function so that all switches performing that given type of switch function are framed by bezel 24. In this manner, the bezel configuration enables the operator to make a rapid tactile identification of switch function type without visual contact of console face 20.

Figure 3:
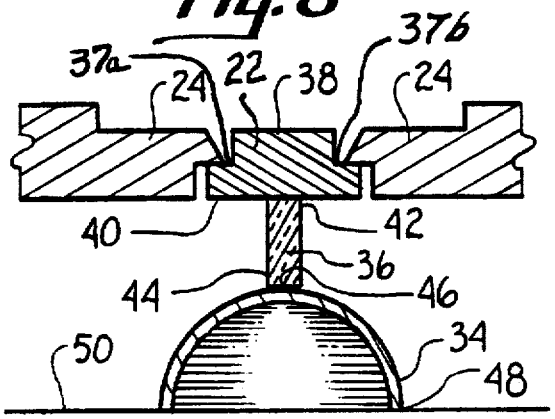
FIG. 3 is a cross-sectional side view of the switch actuator of the present invention.

FIG. 3 shows tactile feedback switch actuator 12 of the present invention in greater detail. Switch actuator 12 comprises key cap 22, collapsible member 34, and linkage 36. Switch actuator 12 is framed by bezel 24. Key cap 22 is a two-sided planar member having shoulder extensions 37*a*, 37*b*. Key cap 22 is positioned atop linkage 36 and biased toward bezel 24 by collapsible member 34 such that shoulders 37*a*, 37*b* abut bezel 24 when switch actuator 12 is inactive. Key cap 22 is reciprocatingly displaceable away from and back to bezel 24. The exposed top side 38 of key cap 22 is fingertip engageable by the operator while the bottom side 40 of key cap 22 engages the top end 42 of rod-shaped linkage 36. Key cap 22 may engage linkage 36 by being attached thereto or being integral therewith. The bottom end 44 of linkage 36 engages dome-shaped collapsible member 34 substantially at the apex 46 of member 34. The circumferential edge 48 of collapsible member 34, which is shown in its uncollapsed state, rests against the top surface 50 of a switch panel. The switch panel is described in greater detail hereafter.

Collapsible member 34, linkage 36, and key cap 22 are characterized as light-transmittable. Thus, elements 34, 36, 22 permit an operator to observe a visible light beam emitted from a source beneath actuator 12. Light transmission is provided by fabricating elements 34, 36, 22 from translucent or transparent materials or by forming holes in opaque materials from which elements 34, 36, 22 are fabricated. Key cap 22 is preferably fabricated from a transparent material. Linkage 36 is preferably a highly-efficient light-transmitting optical fiber having sufficient rigidity to remain substantially inflexible throughout operation of actuator 12.

Figure 4A:
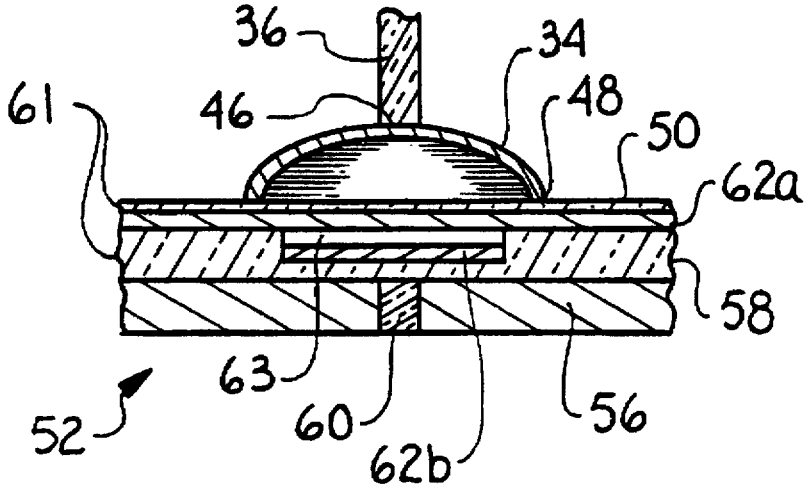
FIG. 4*a* is a partial cross-sectional side view of the switch actuator of the present invention in an intermediate state.

Collapsible member 34 is formed from a resilient material which is capable of reversible collapse with a snap action. Accordingly, when a downward force is applied to member 34 via linkage 36, apex 46 is elastically depressed to an intermediate state as shown in FIG. 4*a*. When the downward force on apex 46 exceeds the modulus of collapse of member 34, member 34 collapses with a tactually detectable snapping action. In the collapsed state shown in FIG. 4*b*, member 34 contacts panel surface 50 at apex 46 as well as at circumferential edge 48. As soon as the force from linkage 36 is released, the collapse of member 34 is reversed and it elastically returns to the uncollapsed state shown in FIG. 3. Preferred materials for collapsible member satisfying these performance criteria are transparent or translucent plastics or opaque plastics or metals having a hole formed through apex 46.

Figure 4B:
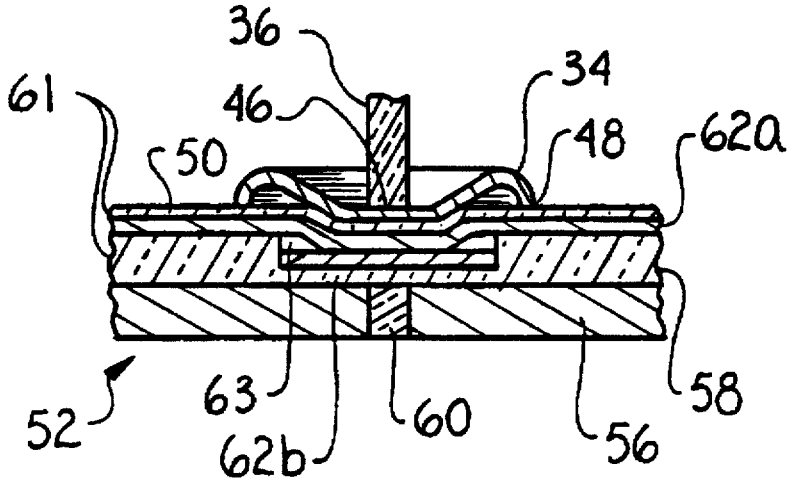
FIG. 4*b* is a partial cross-sectional side view of the switch actuator of the present invention in a collapsed state.
Figure 5:
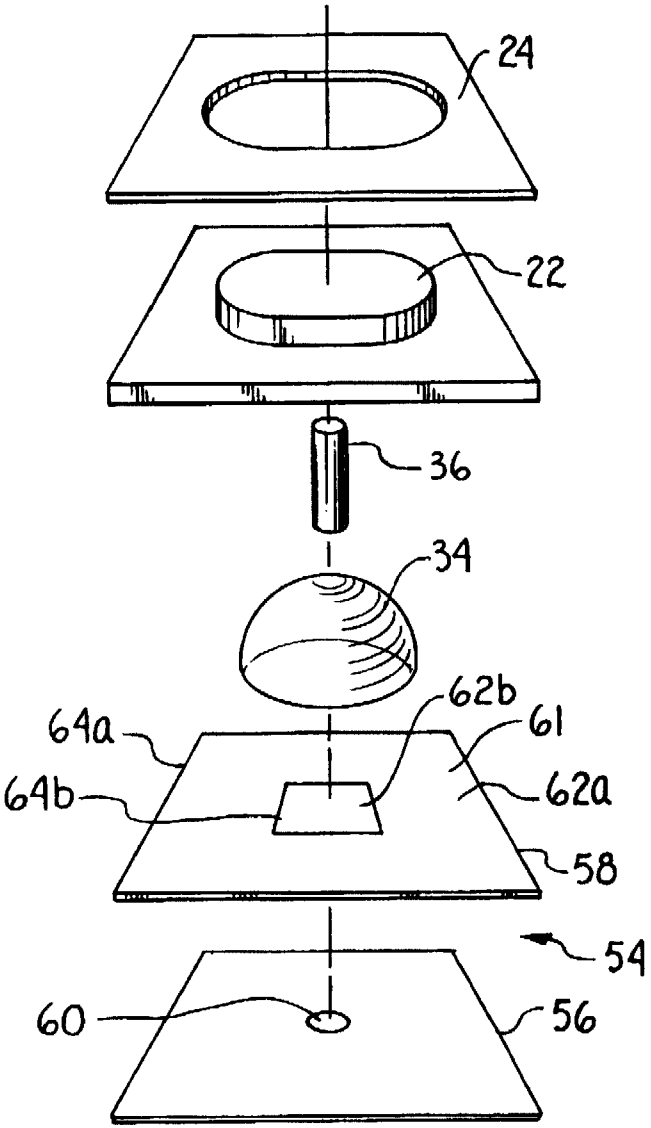
FIG. 5 is an exploded perspective view of the force-actuated switch of the present invention.

FIGS. 4*a*, 4*b* and 5 show the force-actuated switch of the present invention, designated generally as 52, wherein the above-described switch actuator 12 is structurally integrated with an underlying switch panel 54. Accordingly, the collapsible member 34 is disposed upon switch panel 54 which is shown herein as a combination of two stacked panels 56, 58. Switch panel 54 incorporates an E/L panel 56 and a touch panel 58. E/L panel 56 contains a pixel 60 positioned in line with linkage 36 such that when pixel 60 is in an active light-emitting state, its light beam is directed through member 34 and linkage 36 to key cap 22.

Touch panel 58 is a thin planar structure which is substantially light transmittable. Touch panel 58 comprises semi-transparent electrical contacts 62*a*, 62*b* embedded within a sheet 61 of an elastic transparent material such as a clear plastic. Sheet 61 is a single unitary element having contacts 62*a*, 62*b* embedded therein. Although not distinguishable from sheet 61 in the exploded perspective views of FIGS. 5 and 6, it is apparent that contact 62*a* is continuous therewith.

Referring to FIGS. 4*a* and 4*b*, contact 62*a* is continuous with sheet 61 throughout the switch matrix while contact 62*b* is a smaller discrete plane, such as a square, disposed within sheet 61 in specific alignment with an associated switch actuator 12. When member 34 is in an uncollapsed state, a void space 63 is present between contact 62*a* and contact 62*b* as elastically shown in FIG. 4*a*. When member 34 is in a collapsed state, contact 62*a* resides in void space 63 in abutment with contact 62*b*. Contacts 62*a*, 62*b* are provided with electrical leads 64*a*, 64*b* as shown in FIG. 5 which provide electrical communication between contacts 62*a*, 62*b* and remote switch circuitry not shown. When touch panel 58 overlays E/L panel 56, touch panel 58 provides a continuous light pathway from pixel 60 to collapsible member 34.

Figure 6:
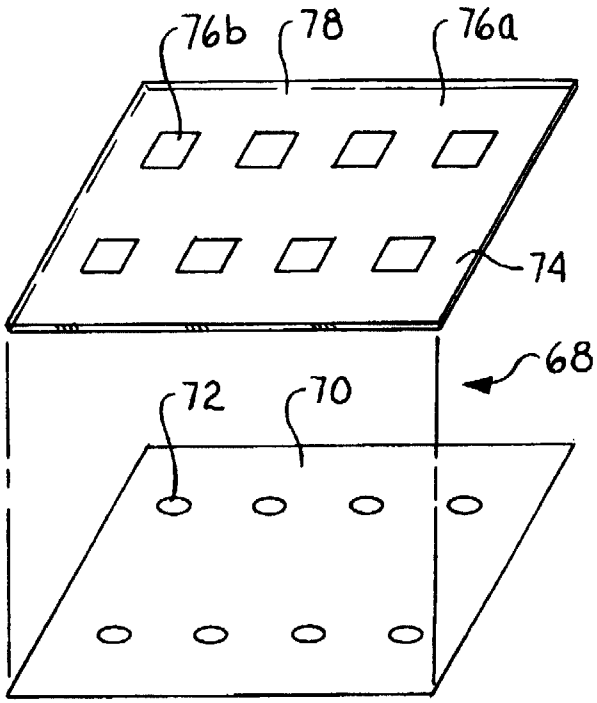
FIG. 6 is an exploded perspective view of a continuous switch panel.

Although panels 56, 58 have been described as two discrete elements which are stacked to form switch panel 54, it is apparent that panels 56, 58 can be integrated into a single unitary switch panel within the scope of the present invention. Further, panels 56, 58 have been described and shown in FIGS. 5 with reference to a single pixel 60 and a single pair of contacts 62*a*, 62*b*. However, it is understood that a continuous switch panel 68, as shown in FIG. 6, can be provided for a switch matrix housed in a console such as shown in FIG. 1. The continuous switch panel 68 of FIG. 6 contains E/L panel 70 having a predetermined pattern of pixels 72 and touch panel 74 having a continuous switch contact 76*a* and a predetermined grid of switch contacts 76*b* embedded within transparent sheet 78. The number of pixels 72 and contacts 76*b* correlate to the number of switches in the matrix.

In operation, switch 52 shown in FIG. 5 is activated by applying a manual actuating force to key cap 22 which exceeds the modulus of collapse of collapsible member 34. The force displaces key cap 22 and associated linkage 36, thereby transmitting the actuating force to collapsible member 34. In response to the actuating force applied thereto, collapsible member 34 elastically deforms as shown in FIG. 4*a*. Member 34 ultimately reaches its modulus of collapse and snaps, thereby collapsing apex 46 against underlying switch surface 50 as shown in FIG. 4*b*. The actuating force is consequently transmitted across apex 46 to pressure-sensitive switch contact 62*a* which is downwardly displaced in void space 63 to engage contact 62*b*. The joining of contacts 62*a*, 62*b* sends a switching signal across leads 64*a*, 64*b* to remote switch circuitry to change operative states. If the newly-actuated operative state is "on", contacts 62*a*, 62*b* also activate pixel 60 causing it to emit a light beam. The light beam is transmitted to the operator across collapsible member 34, linkage 36, and key cap 22, thereby providing the operator with visual feedback of the "on" operative state. If the newly-actuated operative state is "off", contacts 62*a*, 62*b* deactivate pixel 60 causing it to terminate emission of the light beam, thereby providing the operator with visual feedback of the "off" operative state.

When the actuating force to key cap 22 is released, resilient collapsible member 34 and sheet 61 return actuator 12 and contacts 62*a* to their biased positions shown in FIGS. 3 and 4*a* respectively. The aboverecited process is simply repeated if it is desired to send a switching signal which returns the original operative state.

While the particular tactile feedback switch actuator as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

We claim:

1. A low-profile force-actuated switch having a tactile feedback actuator, said switch comprising:

a displaceable light-transmittable key cap wherein said key cap is manually engageable to receive an actuating force from an operator;

a reversibly collapsible light-transmittable convex member wherein said convex member has a reversible snap action upon collapse, thereby providing tactile feedback to the operator of a change in switch operative state;

a light-transmittable linkage connecting said key cap and said convex member and providing for reversible collapse of said convex member upon sufficient displacement of said key cap, said light-transmittable linkage including an optical fiber;

switch contacts including a first switch contact in pressure communication with said key cap and displaceable upon collapse of said convex member to engage a second switch contact and initiate one of at least two operative states wherein said switch contacts are touch panel switch contacts; and a light-emitting panel in light communication with said key cap across said linkage, said convex member, and said switch contacts.

2. The switch as recited in claim 1 wherein said reversibly collapsible light-transmittable convex member has a modulus of collapse and said actuating force is substantially greater than said modulus of collapse of said convex member.

3. The switch as recited in claim 1 wherein at least two of operative states comprises an on operative state and an off operative state.

4. The switch as recited in claim 1 wherein said light emitting panel is activatable in response to engagement of said first and second switch contacts.

5. The switch as recited in claim 1 wherein said light-emitting panel has a pixel aligned with said linkage.

6. The switch as recited in claim 5 wherein said light-emitting panel is integral with said touch panel in a unitary switch panel.

7. The switch as recited in claim 6 wherein said first and second switch contacts are light-transmittable and said second switch contact is aligned with said convex member and said pixel.

8. The switch as recited in claim 1 further comprising a bezel substantially stationary relative to said key cap, said bezel positioned to frame said key cap, thereby maintaining said key cap in light communication with said light-emitting panel.

9. The switch as recited in claim 1 wherein said key cap and convex member are substantially transparent.

10. The switch as recited in claim 1 having a height of less than about 0.2 inches.

11. A low-profile force-actuated switch having a tactile feedback actuator for a touch panel, said switch comprising:

a displaceable light-transmittable key cap;

a reversibly collapsible light-transmittable convex member, the application of actuating force to said reversibly collapsible member collapsing said reversibly collapsible member and applying said actuating force through said reversibly collapsible member to said switch;

a light-transmittable linkage connecting said key cap and said convex member and providing for reversible collapse of said convex member upon sufficient displacement of said key cap, said light-transmittable linkage including an optical fiber;

a bezel substantially stationary relative to said key cap, said bezel having a top surface, said bezel positioned to frame said keycap and thereby maintaining said key cap in position, the top surface of said bezel being contoured to provide tactile identification of switch function type;

switch contacts including a first switch contact in pressure communicate with said key cap and displaceable upon collapse of said convex member to engage a second switch contact and initiate one of at lest two operative states; and a light emitting panel in light communication with said key cap across said linkage, said convex member, and said switch contacts.

12. A force-actuated switch having a tactile feedback actuator as recited in claim 11 wherein the top surface of said bezel is contoured to provide tactile identification of switch function type.

13. A low-profile force-actuated switch having a tactile feedback actuator for a touch panel, said switch comprising:

a displaceable light-transmittable key cap;

a reversibly collapsible light-transmittable convex member;

a light transmittable linkage connecting said key cap and said convex member and providing for reversible collapse of said convex member upon sufficient displacement of said key cap, said light-transmittable linkage including an optical fiber;

a bezel substantially stationary relative to said key cap, said bezel positions to frame said keycap and thereby maintaining said key cap in position, the top surface of said bezel being contoured to provide tactile identification of switch function type;

switch contacts including a first switch contact in pressure communication with said key cap and displaceable upon collapse of said concave member to engage a second switch contact and initiate one of at least two operative states; and a light-emitting panel in light communication with said key cap across said linkage, said convex member, and said switch contacts.

* * * * *